US008042927B2

(12) United States Patent
McCracken

(10) Patent No.: US 8,042,927 B2
(45) Date of Patent: Oct. 25, 2011

(54) MELT RESERVOIR HOUSING

(75) Inventor: Ivan Andrew McCracken, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 579 days.

(21) Appl. No.: 12/241,542

(22) Filed: Sep. 30, 2008

(65) Prior Publication Data

US 2010/0079563 A1 Apr. 1, 2010

(51) Int. Cl.
*B41J 2/175* (2006.01)

(52) U.S. Cl. ..... 347/88; 347/85; 347/99

(58) Field of Classification Search ..... None
See application file for complete search history.

(56) References Cited

U.S. PATENT DOCUMENTS

| | | | | |
|---|---|---|---|---|
| 4,739,339 | A | 4/1988 | DeYoung et al. | |
| 4,814,786 | A | 3/1989 | Hoisington et al. | |
| 5,742,313 | A | 4/1998 | Hine | |
| 5,821,963 | A * | 10/1998 | Sutera et al. | 347/75 |
| 6,199,699 | B1 | 3/2001 | Eastman | |
| 7,204,578 | B2 * | 4/2007 | Harvey et al. | 347/40 |
| 7,268,359 | B2 | 9/2007 | Fu et al. | |
| 2006/0017788 | A1 | 1/2006 | Otis, Jr. et al. | |

FOREIGN PATENT DOCUMENTS

| | | |
|---|---|---|
| EP | 1504910 | 2/2005 |
| EP | 1510347 | 3/2005 |

OTHER PUBLICATIONS

European Search Report, European Patent Office, Munich, DE, Jan. 19, 2010, 8 pages.

* cited by examiner

*Primary Examiner* — Matthew Luu
*Assistant Examiner* — Erica Lin
(74) *Attorney, Agent, or Firm* — Maginot, Moore & Beck LLP

(57) ABSTRACT

An ink storage and supply assembly includes at least one ink reservoir configured to hold a quantity of liquid ink and to communicate the ink to at least one printhead of an imaging device. A housing at least partially encloses the at least one ink reservoir and includes a top, a bottom, and a plurality of side walls extending vertically between the top and the bottom of the housing. The plurality of side walls are spaced from the at least one reservoir to define a first air gap between each of the side walls and the at least one reservoir. At least one the side walls includes an inner wall and an outer wall spaced from each other to define a second air gap therebetween.

15 Claims, 7 Drawing Sheets

MELT RESERVOIR HOUSING

TECHNICAL FIELD

This disclosure relates generally to phase change ink printers, and in particular, to ink reservoirs for maintaining a supply of phase change ink in liquid form for delivery to one or more printheads of the phase change ink printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a melt reservoir.

The melt reservoir is configured to maintain a quantity of melted ink in liquid or melted form and to communicate the melted ink to one or more printheads as needed. Thermal energy is applied to the melt reservoir to maintain the phase change ink stored therein at a substantially constant temperature which is above the freezing point, or solidification point, of the melted phase change ink. One issue faced in maintaining the melt reservoirs of a phase change ink printer at the melted ink temperature is heat loss. Heat loss from the melt reservoir requires more thermal energy input to the reservoirs to maintain the ink at the melted ink temperature which, in turn, increases the energy consumption of the printer.

SUMMARY

In order to prevent or limit heat loss from the melt reservoirs of a phase change ink imaging device, an ink storage and supply assembly has been developed that includes at least one ink reservoir positioned in an imaging device. The at least one ink reservoir has an opening configured to receive liquid ink, and a chamber configured to hold a quantity of the ink received through the opening. The at least one ink reservoir is configured to communicate the liquid ink in the chamber to at least one printhead of the imaging device. A housing at least partially encloses the at least one ink reservoir. The housing includes a top positioned above the at least one ink reservoir, a bottom positioned below that at least one ink reservoir, and a plurality of side walls extending vertically between the top and the bottom of the housing. The plurality of side walls are formed of mica panels and are spaced from the at least one reservoir to define a first air gap between each of the side walls and the at least one reservoir. At least one the side walls includes an inner wall and an outer wall spaced from each other to define a second air gap therebetween. The top and bottom of the housing includes locating grooves for receiving edges of the plurality of side walls and for positioning the side walls to provide the first air gap and the second air gap.

In another embodiment, an ink storage and supply assembly comprises at least one ink reservoir positioned in an imaging device. The at least one ink reservoir has an opening configured to receive liquid ink, and a chamber configured to hold a quantity of the ink received through the opening. The at least one ink reservoir is configured to communicate the liquid ink in the chamber to at least one printhead of the imaging device. A housing at least partially encloses the at least one ink reservoir. The housing includes a top positioned above the at least one ink reservoir, a bottom positioned below that at least one ink reservoir, and a plurality of side walls extending vertically between the top and the bottom of the housing. The plurality of side walls are spaced from the at least one reservoir to define a first air gap between each of the side walls and the at least one reservoir.

In yet another embodiment, an imaging device is provided that includes at least one printhead for ejecting ink onto an ink receiver. The imaging device includes at least one ink reservoir configured to hold liquid ink and to deliver ink to the at least one print head. The at least one ink reservoir includes a housing that at least partially encloses the at least one ink reservoir. The housing includes a top positioned above the at least one ink reservoir, a bottom positioned below that at least one ink reservoir, and a plurality of side walls extending vertically between the top and the bottom of the housing. At least one of the side walls in the plurality is spaced from the at least one reservoir defining an air gap therebetween.

DETAILED DESCRIPTION OF THE PREFERRED EMBODIMENT

Figure 1:
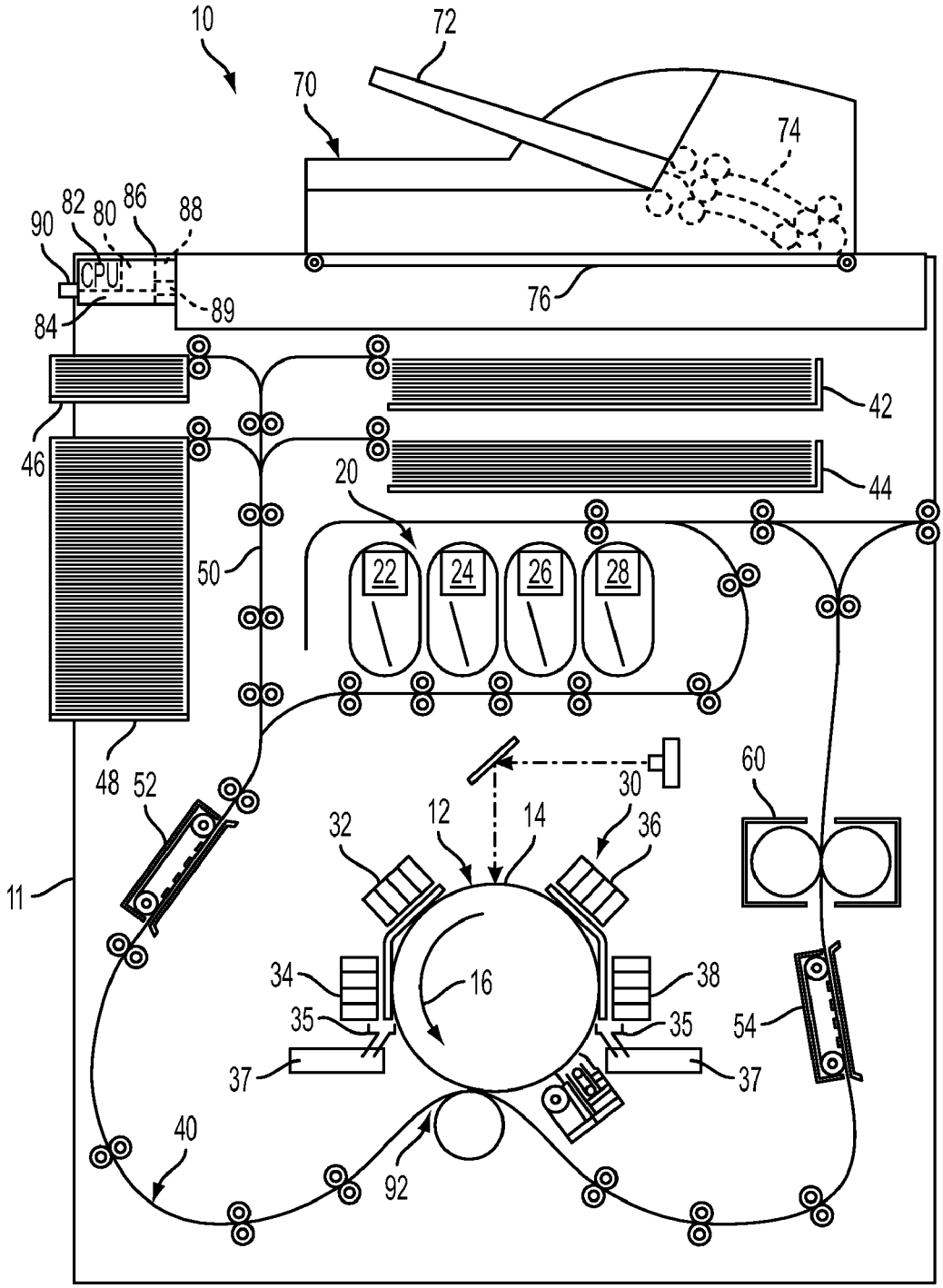
FIG. 1 is block diagram of a phase change ink image producing machine.

For a general understanding of the system disclosed herein as well as the details for the system and method, reference is made to the drawings. In the drawings, like reference numerals have been used throughout to designate like elements. As used herein, the word "printer," "imaging device," "image producing machine," etc. encompasses any apparatus that performs a print outputting function for any purpose, such as a digital copier, bookmaking machine, facsimile machine, a multi-function machine, etc.

Referring now to FIG. 1, there is illustrated an image producing machine, such as the high-speed phase change ink image producing machine or printer 10 of the present invention. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink system 20 that has at least one source 22 of one color phase change ink in solid form. Since the phase change ink image producing machine or printer 10 is a multicolor image producing machine, the ink system 20 includes for example four (4) sources 22, 24, 26, 28, representing four (4) different colors CYMK (cyan, yellow, magenta, black) of phase change inks. The phase change ink system 20 also includes a phase change ink melting and control assembly 100 (FIG. 2), for melting or phase changing the solid form of the phase change ink into a liquid form. Thereafter, the phase change ink melting and control assembly 100 then controls and supplies the molten liquid form of the ink towards a printhead system 30 including at least one printhead assembly 32. Since the phase change ink image producing machine or printer 10 is a high-speed, or high throughput, multicolor image producing machine, the printhead system includes for example four (4) separate printhead assemblies 32, 34, 36 and 38 as shown.

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 92, from the surface 14 onto the receiving substrate for subsequent fusing at fusing device 60.

Figure 2:
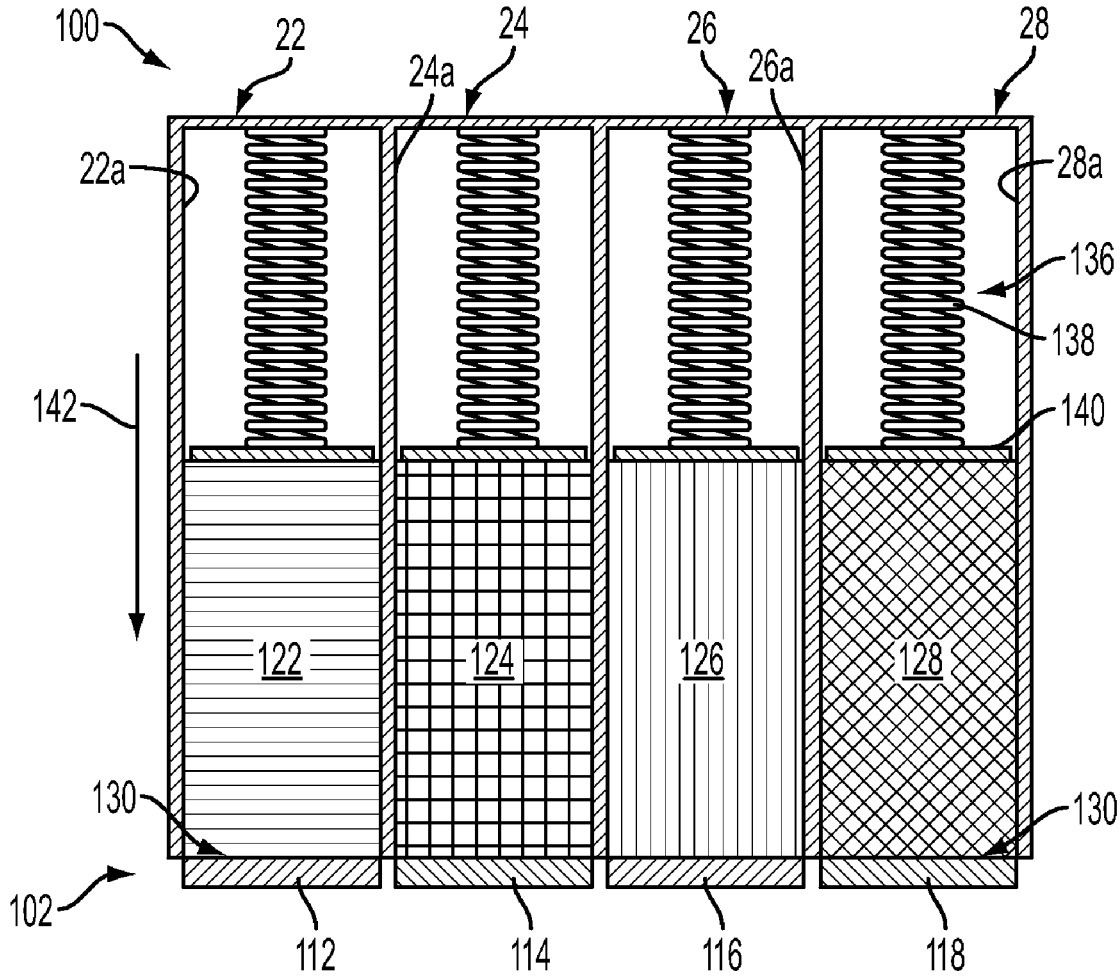
FIG. 2 is top view of four ink sources and a melter assembly having four melter plates of the phase change ink image producing machine of FIG. 1.
Figure 3:
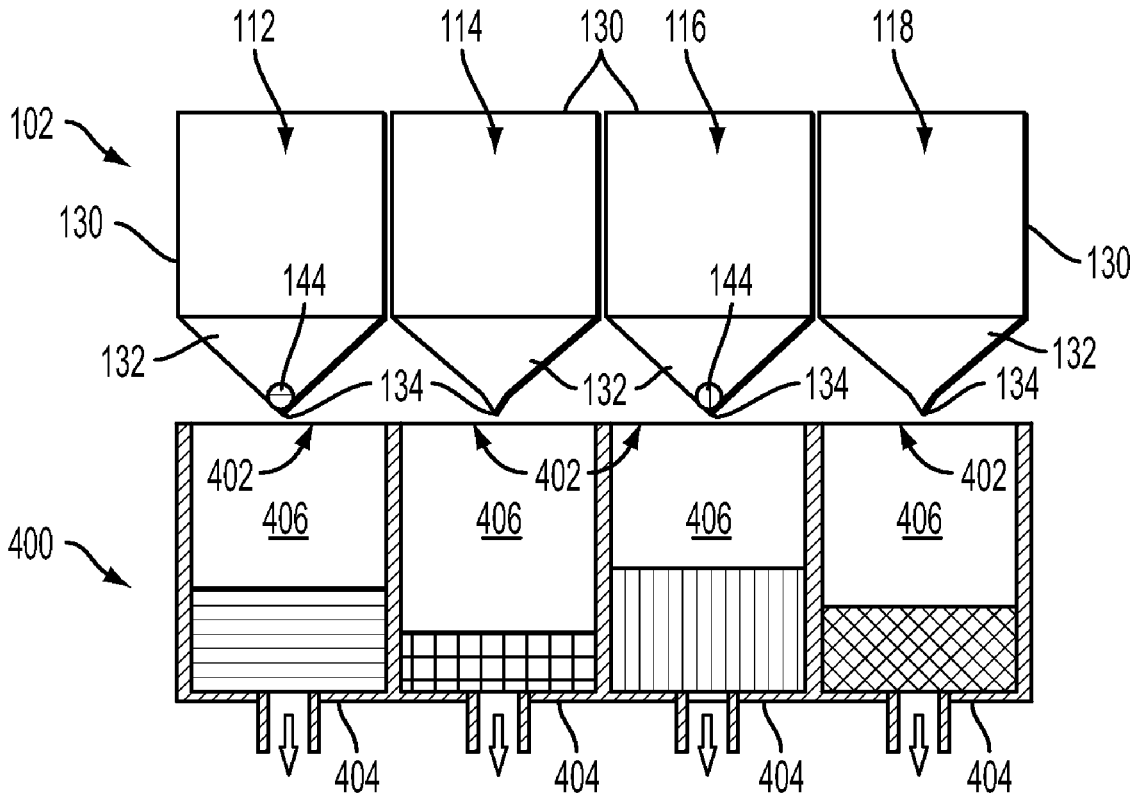
FIG. 3 is front side view of the four melter plates and the ink melting and control assembly.

Referring now to FIGS. 2 and 3, there is shown the ink delivery system 100 and ink storage and supply assembly 400 of the imaging device. The ink delivery system 100 of the present example includes four ink sources 22, 24, 26, 28, each holding a different phase change ink in solid form, such as for example inks of different colors. However, the ink delivery system 100 may include any suitable number of ink sources, each capable of holding a different phase change ink in solid form. The different solid inks are referred to herein by their colors as CYMK, including cyan 122, yellow 124, magenta 126, and black 128. Each ink source can include a housing (not shown) for storing each solid ink separately from the others. The solid inks are typically in block form, though the solid phase change ink may be in other formats, including but not limited to, pellets and granules, among others.

The ink delivery system 100 includes a melter assembly, shown generally at 102. The melter assembly 102 includes a melter, such as a melter plate, connected to the ink source for melting the solid phase change ink into the liquid phase. In the example provided herein, the melter assembly 102 includes four melter plates, 112, 114, 116, 118 each corresponding to a separate ink source 22, 24, 26 and 28 respectively, and connected thereto. As shown in FIG. 3, each melter plate 112, 114, 116, 118 includes an ink contact portion 130 and a drip point portion 132 extending below the ink contact portion and terminating in a drip point 134 at the lowest end. The drip point portion 132 can be a narrowing portion terminating in the drip point.

The melter plates 112, 114, 116, 118 can be formed of a thermally conductive material, such as metal, among others, that is heated in a known manner. In one embodiment, solid phase change ink is heated to about 100° C. to 140° C. to melt the phase change ink to liquid form for supplying to the liquid ink storage and supply assembly 400. As each color ink melts, the ink adheres to its corresponding melter plate 112, 114, 116 118, and gravity moves the liquid ink down to the drip point 134 which is disposed lower than the contact portion. The liquid phase change ink then drips from the drip point 134 in drops shown at 144. The melted ink from the melters may be directed gravitationally or by other means to the ink storage and supply assembly 400. The ink storage and supply system 400 includes reservoirs 404 configured to hold quantities of melted ink from the corresponding ink sources/melters and to communicate the melted ink to one or more printheads (not shown) as needed. Each reservoir 404 of the ink storage and supply system 400 includes an opening 402 positioned below the corresponding melt plate configured to receive the melted ink and a chamber 406 below the opening configured to hold a volume of the melted ink received from the corresponding melt plate.

Figure 4:
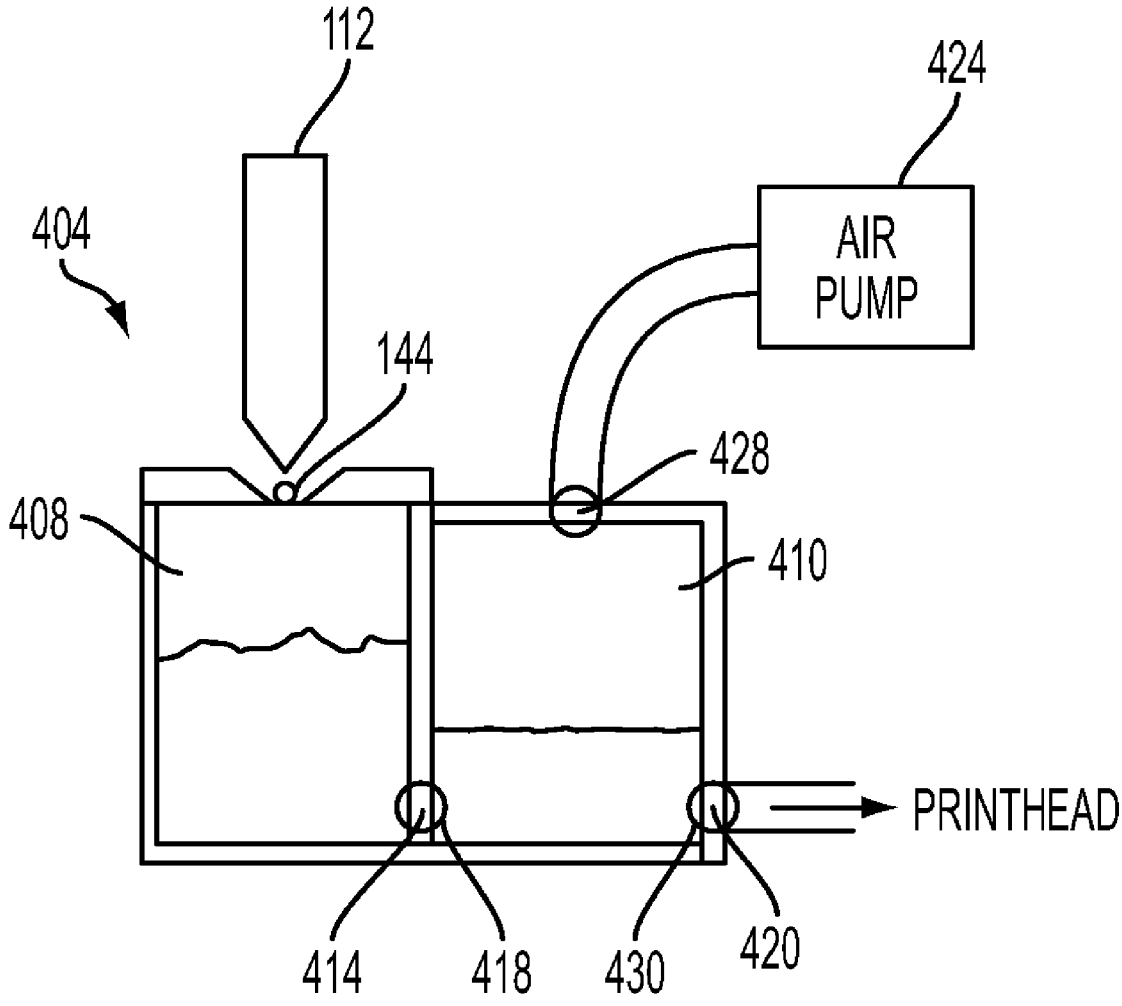
FIG. 4 is a side cross-sectional view of a dual reservoir of the ink melting and control assembly.

In one embodiment, the ink storage and supply system 400 may incorporate a dual reservoir system. FIG. 4 shows a simplified side cross-sectional view of an exemplary embodiment of a dual reservoir of an ink storage and supply assembly 400. In this embodiment, each reservoir 404 of the ink storage and control assembly 400 includes a primary reservoir 408 and a secondary reservoir 410 for each ink source and corresponding ink melter of the ink delivery system. Only one dual reservoir is shown in FIG. 4, but it is to be understood that each reservoir 404 of the ink storage and control assembly 400 may be configured as a dual reservoir as depicted in FIG. 4. In the embodiment of FIG. 4, each primary reservoir 408 comprises a low pressure reservoir (LPR) configured to receive molten ink from a corresponding ink melt plate (for example, melt plate 112) of the ink delivery system. Each LPR 408 includes an opening 414 at or near a bottom portion of the LPR 408 through which ink may flow to a corresponding secondary reservoir 410. Gravity, or liquid ink height, may serve as the driving force for causing the molten ink to exit a respective LPR 408 through the opening and into the corresponding secondary reservoir 410. To prevent backflow of ink from a secondary reservoir 410 to the corresponding primary reservoir (LPR) 408, the openings 414 in the LPR's may be provided with one-way check valves 418 that permit ink to flow gravitationally from the LPR 408 into the secondary reservoir 410.

The secondary reservoirs 410 comprise high pressure reservoirs (HPR). Each HPR 410 includes at least one discharge outlet 420 through which molten ink may flow to an ink routing assembly (not shown) for directing ink to one or more printheads (not shown) of the printhead assembly. Each HPR may include a plurality of discharge outlets 420 for supplying ink to a plurality of printheads. For example, in a system that includes four printheads for each color of ink, each HPR may include four discharge outlets, each outlet being configured to supply ink to a different printhead. When charging a printhead with ink, pressure is applied to the ink in a corresponding HPR using, for example, an air pump 424 through a dosing valve 428 or other suitable pressurization means to causing the ink to discharge through the one or more discharge outlets 420 of the HPR. The discharge outlet(s) of the HPR may include check valve(s) 430 or other suitable backflow prevention means that are configured to open to permit the flow of molten ink from the secondary reservoir to the printhead when the HPR is pressurized while preventing backflow of the ink through the opening 420 back into the HPR 410. In addition, the valve 418 in the opening 414 is configured to prevent backflow of ink from the secondary reservoir to the primary reservoir when the secondary reservoir is pressurized.

The primary and secondary reservoirs are configured to maintain the phase change ink stored therein at a substantially constant melted ink temperature that is above a freezing point, or solidification point, of the phase change ink in order to maintain the ink in liquid or melted form for delivery to one or more printheads of the printhead assembly. Accordingly, the primary 408 and secondary reservoirs 410 of the melt reservoir system 400 are formed of a thermally conductive material such as aluminum although any suitable material, such as magnesium, may be used. The development of thermal energy in the primary and secondary reservoirs to maintain the phase change ink at the melted ink temperature may be accomplished in any suitable manner. For example, the ink storage and supply assembly 400 may include one or more heating elements (not shown), such as silicon heaters, that are disposed adjacent to the primary 408 and/or the secondary reservoirs 410 that are configured to heat the primary and second reservoirs to a temperature suitable to maintain the phase change ink at the melted ink temperature.

One issue faced in ink handling in an imaging device is maintaining the temperature of the ink at the desired temperature. For example, in the phase change ink imaging device described above, it is desired that the phase change ink in the reservoirs be maintained at the melted ink temperature for delivery to the print heads. A difficulty faced in maintaining phase change ink at the melted ink temperature is heat loss. Heat loss in the primary and secondary reservoirs requires more thermal energy input to the reservoirs to maintain the ink at the melted ink temperature which increases the energy consumption of the printer which, in turn, is undesirable in today's "green" climate as well as being an impediment to meeting energy star and other regulatory operation objectives. Temperature control of ink may also be an issue in imaging devices that utilize other types of ink. In imaging devices that utilize ink, such as aqueous ink, it may be desired to maintain the ink at a room temperature of approximately 18° C. to 25° C. The environment in which the imaging device is located, however, may provide additional sources of heating and/or cooling that may have an affect on the ink temperature in the imaging device. In addition, the internal components of an imaging device may generate heat that may also affect ink temperature in an imaging device.

Figure 5:
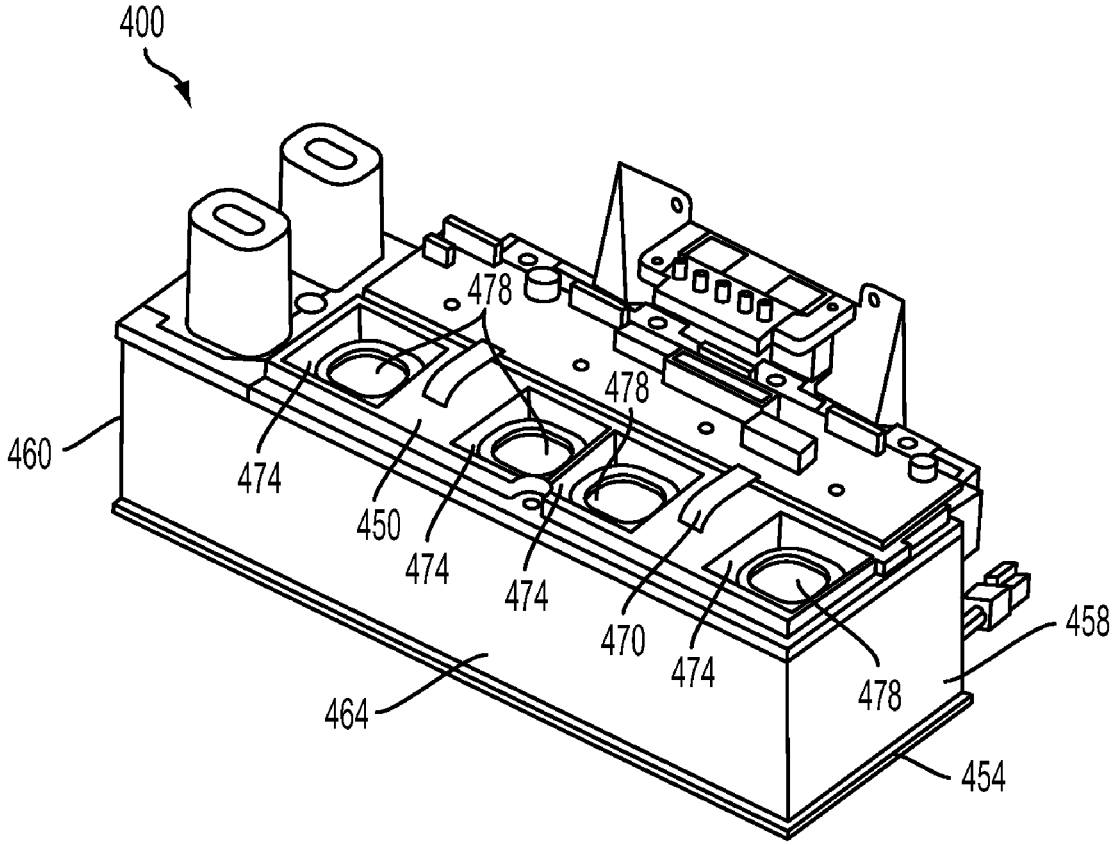
FIG. 5 is a front perspective view of the ink melting and control assembly showing the insulated housing.
Figure 6:
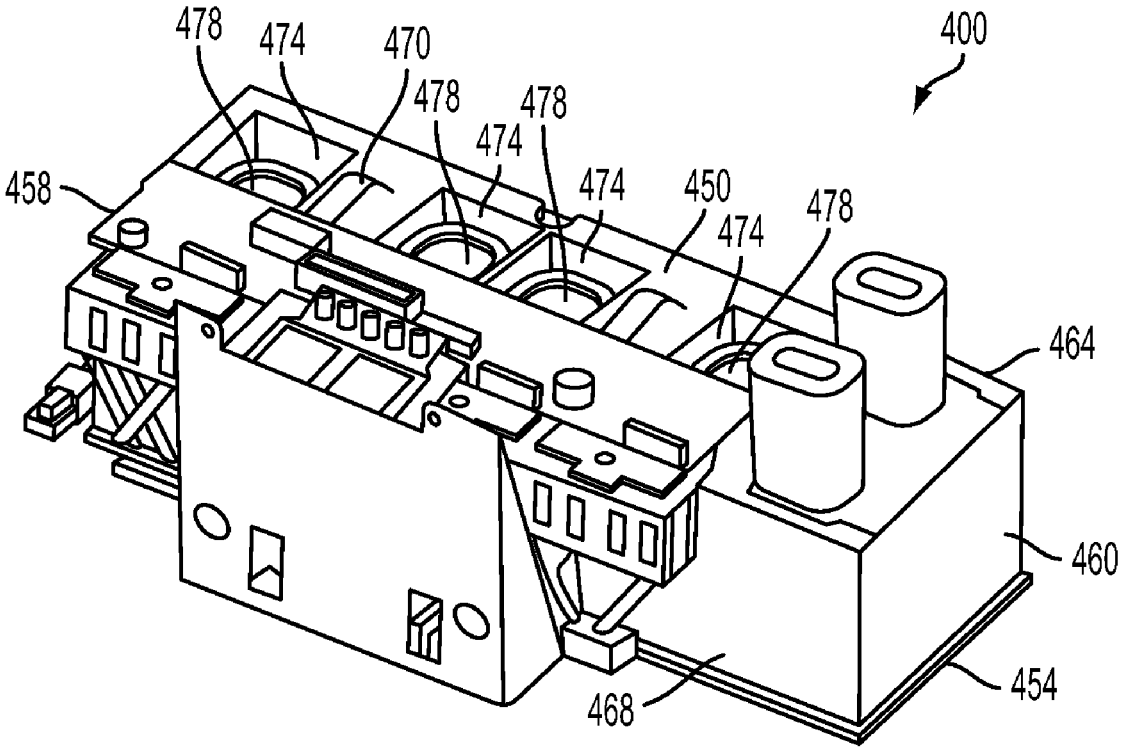
FIG. 6 is a back perspective view of the ink melting and control assembly showing the insulated housing.

In order to minimize heat loss and/or heat gain in the ink storage and supply assembly, the ink storage and supply assembly includes an insulated housing assembly configured to surround the primary and secondary reservoirs of the ink storage and supply assembly to minimize heat loss and/or heat gain. FIGS. 5 and 6 show front and back perspective views of an embodiment of an ink storage and control assembly 400 that shows an exemplary insulated housing assembly. In particular, the insulated housing includes a top portion 450, a bottom portion 454, and a plurality of side walls or panels 458, 460, 464, 468 that surround and enclose the primary and secondary reservoirs (not shown in FIGS. 5 and 6) of the ink storage and supply assembly 400. As seen in FIGS. 5 and 6, the top portion 450 of the housing may include an ink collector 470 configured to collect and direct the molten ink received from the melt plates to the corresponding low pressure reservoirs 408. The ink collector 470 may be formed of an insulating material such as plastic and includes an opening 474 positioned above each low pressure reservoir that is configured to collect the molten ink as it drips from the corresponding ink melter and to funnel the ink through a filter 478 and into the corresponding low pressure ink reservoir. The bottom 454 of the housing is positioned below the reservoirs of the ink storage and supply assembly 400. The side walls 458, 460, 464, 468 of the housing are oriented substantially vertically about the sides of the ink storage and supply assembly extending between the top and the bottom of the housing. In the embodiment of FIGS. 5 and 6, the side walls include a pair of end side walls 458, 460 and a pair of longitudinal side walls 464, 468.

In one embodiment, the top, bottom, and side panels of the reservoir housing comprise a glass-filled plastic. Plastic molded parts are relatively easy to fashion in the desired shape and can include features for attachment. However, the downside to this approach is the plastic parts are not optimal as an insulator or as a low cost solution. As an alternative to using plastics for the insulated housing of the ink storage and supply assembly, the insulated housing of the ink storage and supply assembly may include mica panels to reduce cost and reduce heat loss. In particular, in one embodiment, at least the side panels 458, 460, 464, 468 of the insulated housing may be formed of mica sheets, also known as muscovite. The thickness of the mica panels utilized in the housing may be any suitable thickness. In one embodiment, the mica panels are provided with a thickness of about 0.030".

Figure 7:
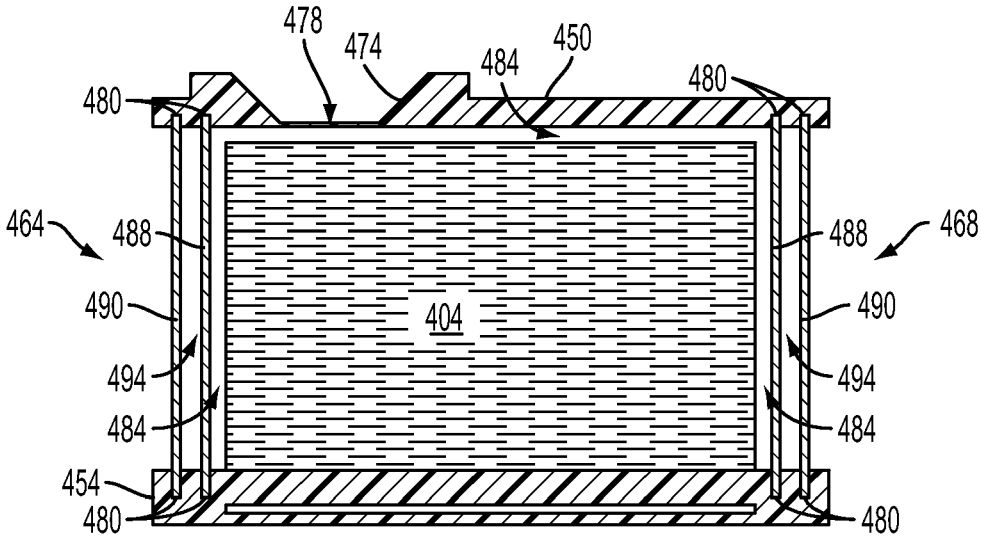
FIG. 7 is an end cross-sectional view of the ink melting and control assembly showing the panel spacing and air gaps between the panels and between the panels and the reservoirs.

The top 450 and bottom portions 454 of the housing may be formed of a suitable thermally resistant material such as plastic which enables the formation of locating and attachment features, such as guide grooves or slots, for positioning the mica side panels relative to the melt reservoirs and to each other. FIG. 7 shows a simplified side cross-sectional view of the ink storage and supply assembly 400 showing the top portion 450, bottom portion 454, and longitudinal side walls 464, 468. As seen in FIG. 7, the top 450 and bottom portions 454 of the housing may include guide grooves or slots 480 that are configured to receive the top and bottom edges, respectively, of the side walls 464, 468. Although not depicted in FIG. 7, the top and bottom portions of the housing includes guide grooves or slots that are configured to receive the top and bottom edges, respectively, of the end side walls 458, 460. Although not necessary in every embodiment, the panels may be secured and sealed to the top and bottom portions of the housing as well as to adjacent or overlapping panels using a suitable sealing material such as tape, or a thermally cured adhesive. By confining the locating and attachment features to the top and bottom portions of the housing, the mica side panels may be formed of simple stamped mica sheets. For example, the raw material for the mica panels comes in sheets at the thickness desired, and the panels may be formed, for example, by stamping out the profile with a single blanking die.

To further minimize heat loss or heat gain in the ink storage and supply assembly 400, the housing of the ink storage and supply assembly 400 is configured to make use of trapped air to enhance the thermal insulating properties of the housing. As is known in the art, the insulating properties of the air far exceed those of a solid. The housing of the ink storage and supply assembly 400 is configured to use trapped air as insulation by spacing one or more or all of the side walls 458, 460, 464, 468 from the heated reservoirs 404 of the ink storage and supply assembly 400 to provide an air gap 484 between the heated reservoirs and the housing walls. The top and bottom portions of the housing and/or the reservoirs 404 may also be provided with positioning and/or locating features such as standoffs (not shown) that allow precise positioning of the top, bottom and side walls of the housing with respect to the reservoirs 404 so that air gaps may be provided between the heated reservoirs and the top and bottom portions of the housing as well as between the side walls and the reservoirs. Air gaps provided between the housing walls and the reservoirs 404 may have any suitable width. In one embodiment, the air gap 484 between the side walls of the housing and the reservoirs may be approximately 0.080" although any suitable air gap width may be provided.

Figure 8:
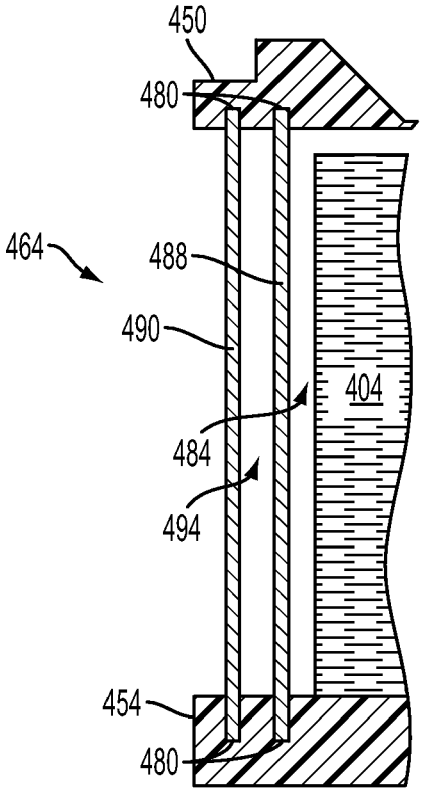
FIG. 8 is an enlarged view of a portion of the end cross-sectional view of the ink melting and control assembly shown in FIG. 7.

As depicted in FIG. 7, select one or more of the side walls of the housing may be provided with two or more layers of mica panels. Multi-layer housing walls or panels that include multiple layers of mica may also be configured to make use of entrapped air to decrease the thermal conductivity of the particular housing wall. In the embodiment of FIG. 7, each of the side walls 464, 468 of the housing are provided with two mica panels 488, 490 that are positioned with respect to each other to provide an air gap 494 therebetween. In particular, as shown in FIG. 8, the side walls 464, 468 (only side 464 depicted in FIG. 8) may be provided with an inner panel 488 and an outer panel 490 that are spaced from each other to provide the air gap 494. The distance between the mica panels 488, 490 of the double layer sidewalls of the housing that defines the air gap 494 may be any suitable distance. In one embodiment, the width of the air gap between the mica panels of the double layer sidewalls may be approximately 0.080" although the air gap may have any suitable width.

The housing of the ink storage and supply assembly has been described as having one or more side walls with two mica panels that utilize trapped air to enhance the ability of the housing to reduce heat loss, more than two mica panels may be provided in one or more of the side walls with an air gap between each mica panel. In addition, although not depicted, mica panels may be incorporated into the top and bottom portions of the housing. For example, the bottom portion of the housing may be provided with a mica panel that is configured to be sandwiched between the bottom of the ink storage and supply assembly and the plastic bottom portion of the housing. In addition, the top and bottom portions of the housing may be formed of other materials besides plastic and/or may include suitable fillers that are configured to further increase the ability of the housing to prevent or limit heat loss.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An ink storage and supply assembly comprising at least one ink reservoir positioned in an imaging device, the at least one ink reservoir being formed with a thermally conductive material configured to have an opening through which liquid ink is received into the at least one reservoir and a chamber configured to hold a quantity of the liquid ink received through the opening, the at least one ink reservoir being configured to communicate the liquid ink held in the chamber to at least one printhead of the imaging device; and a housing at least partially enclosing the at least one ink reservoir, the housing including a top wall positioned above the at least one ink reservoir, a bottom wall positioned below the at least one ink reservoir, and a plurality of side walls extending vertically between the top wall and the bottom wall of the housing, the plurality of side walls being formed of mica panels and being spaced from the thermally conductive material of the at least one reservoir to form a first air gap between each of the side walls and the at least one reservoir, at least one of the side walls including an inner wall that forms the first air gap with the at least one reservoir and an outer wall that is spaced from the inner wall to form a second air gap between the inner wall and the outer wall, the top wall and the bottom wall of the housing being formed with a thermally resistant material, the top wall and the bottom wall of the housing including locating grooves, each locating groove being configured to receive an edge of one side wall in the plurality of side walls to position the side walls about the at least one reservoir to form the first air gap and to form the second air gap between the inner wall and the outer wall of the at least one side wall.

2. The assembly of claim 1, the thermally resistant material from which the top wall and the bottom wall of the housing are formed is essentially comprised of plastic.

3. The assembly of claim 2, the mica panels of the plurality of side walls each having a thickness of approximately 0.030".

4. The assembly of claim 3, the first air gap having a width of approximately 0.080".

5. The assembly of claim 4, the second air gap having a width of approximately 0.080".

6. The assembly of claim 5, the at least one ink reservoir being configured to receive melted phase change ink through the opening of the at least one reservoir and to communicate the melted phase change ink to a phase change ink print head in the imaging device.

7. The assembly of claim 6, the at least one ink reservoir further comprising:

a heater for generating heat in the at least one ink reservoir to maintain the phase change ink in the at least one ink reservoir at a melted ink temperature that keeps the liquid ink in the liquid phase.

8. The assembly of claim 7, the at least one ink reservoir further comprising:

four ink reservoirs, each of the four ink reservoirs including an opening configured to couple to a different source of melted phase change ink and a chamber for holding a quantity of the respective melted phase change ink; and the housing being configured to partially enclose the four ink reservoirs to form the first air gap between each side wall and the four ink reservoirs.

9. An ink storage and supply assembly comprising:

at least one ink reservoir positioned in an imaging device, the at least one ink reservoir being formed with a thermally conductive material configured to have an opening through which liquid ink is received into the at least one reservoir and a chamber configured to hold a quantity of the liquid ink received through the opening, the at least one ink reservoir being configured to communicate the liquid ink held in the chamber to at least one printhead of the imaging device; and a housing at least partially enclosing the at least one ink reservoir, the housing including a top wall positioned above the at least one ink reservoir, a bottom wall positioned below the at least one ink reservoir, and a plurality of side walls extending vertically between the top wall and the bottom wall of the housing, the plurality of side walls being spaced from the at least one reservoir to form a first air gap between each of the side walls and the at least one reservoir;

at least one of the side walls including an inner wall that forms the first air gap with the at least one reservoir and an outer wall that is spaced from the inner wall to form a second air gap between the inner wall and the outer wall, the top wall and the bottom wall of the housing including locating grooves, each locating groove being configured to receive an edge of one side wall in the plurality of side walls to position the side walls about the at least one reservoir to form the first air gap and to form the second air gap between the inner wall and the outer wall of the at least one side wall.

10. The assembly of claim 9, the plurality of side walls being formed of mica panels.

11. The assembly of claim 10, the mica panels having a thickness of approximately 0.030".

12. The assembly of claim 9, the top wall and the bottom wall of the housing being formed of a thermally resistant plastic material.

13. The assembly of claim 9, the at least one ink reservoir being configured to receive melted phase change ink through the opening and to communicate the melted phase change ink to a phase change ink print head in the imaging device.

14. The assembly of claim 13, the at least one ink reservoir further comprising: a heater for generating heat in the at least one ink reservoir to maintain the phase change ink held in the at least one reservoir at a temperature that keeps the liquid ink the liquid phase.

15. The assembly of claim 9, the second air gap having a width between the mica panels of approximately 0.080".

* * * * *